US009391363B2

(12) United States Patent
Choi et al.

(10) Patent No.: US 9,391,363 B2
(45) Date of Patent: Jul. 12, 2016

(54) MULTILAYER FERRITE SHEET, ANTENNA DEVICE USING THE SAME, AND MANUFACTURING METHOD THEREOF

(71) Applicant: SAMSUNG ELECTRO-MACHANICS CO., LTD., Suwon (KR)

(72) Inventors: Dong Hyeok Choi, Suwon (KR); Jin Young Kim, Suwon (KR); Sung Yong An, Suwon (KR); Ji Man Ryu, Suwon (KR)

(73) Assignee: SAMSUNG ELECTRO-MECHANICS CO., LTD., Suwon, Gyunggi-Do (KR)

( * ) Notice: Subject to any disclaimer, the term of this patent is extended or adjusted under 35 U.S.C. 154(b) by 313 days.

(21) Appl. No.: 13/788,999

(22) Filed: Mar. 7, 2013

(65) Prior Publication Data

US 2014/0176380 A1 Jun. 26, 2014

(30) Foreign Application Priority Data

Dec. 21, 2012 (KR) ..... 10-2012-0150521

(51) Int. Cl.
*H01Q 1/36* (2006.01)
*H01Q 1/38* (2006.01)

(52) U.S. Cl.
CPC ..... *H01Q 1/38* (2013.01); *Y10T 156/10* (2015.01); *Y10T 156/1052* (2015.01); *Y10T 428/2495* (2015.01); *Y10T 428/325* (2015.01)

(58) Field of Classification Search
CPC .. H01Q 1/38; Y10T 156/10; Y10T 156/1052; Y10T 428/2495; Y10T 428/325
USPC ..... 343/787, 895; 428/693, 213; 156/60, 156/250
See application file for complete search history.

(56) References Cited

U.S. PATENT DOCUMENTS

| | | | | |
|---|---|---|---|---|
| 4,063,229 | A * | 12/1977 | Welsh et al. | 340/571 |
| 5,912,622 | A * | 6/1999 | Endo | B62H 5/20 29/846 |
| 8,981,890 | B2 * | 3/2015 | An et al. | 336/200 |
| 2007/0001921 | A1 * | 1/2007 | Takahashi | H01Q 1/38 343/788 |
| 2012/0235871 | A1 * | 9/2012 | Taniguchi et al. | 343/749 |
| 2014/0132376 | A1 * | 5/2014 | Jin | 335/302 |

FOREIGN PATENT DOCUMENTS

| | | |
|---|---|---|
| JP | 2012-134577 | 7/2012 |
| KR | 10-2011-0136409 | 12/2011 |

* cited by examiner

*Primary Examiner* — Hoanganh Le
(74) *Attorney, Agent, or Firm* — McDermott Will & Emery LLP

(57) ABSTRACT

There are provided a multilayer ferrite sheet capable of performing communications in a wideband frequency, an antenna device using the same, and a manufacturing method thereof. The multilayer ferrite sheet includes: a Y-type hexaferrite layer; and a Z-type hexaferrite layer, wherein the Y-type hexaferrite and the Z-type hexaferrite are alternately laminated.

17 Claims, 6 Drawing Sheets

MULTILAYER FERRITE SHEET, ANTENNA DEVICE USING THE SAME, AND MANUFACTURING METHOD THEREOF

CROSS-REFERENCE TO RELATED APPLICATIONS

This application claims the priority of Korean Patent Application No. 10-2012-0150521 filed on Dec. 21, 2012, in the Korean Intellectual Property Office, the disclosure of which is incorporated herein by reference.

BACKGROUND OF THE INVENTION

1. Field of the Invention

The present invention relates to a multilayer ferrite sheet, an antenna device using the same, and a manufacturing method thereof, and more particularly, to a multilayer ferrite sheet capable of performing communications in a wideband frequency, an antenna device using the same, and a manufacturing method thereof.

2. Description of the Related Art

Recently, as various wireless communications/wireless broadcast services have been introduced to mobile devices such as smartphones, and the like, a single terminal is required to support a variety of functions, and thus, an antenna device having multi-band and wideband characteristics is required.

In a small antenna device based on a dielectric substance, means for obtaining wideband and multi-band characteristics are focused on changing a shape of an antenna radiator. However, mobile devices have become increasingly lighter, thinner, shorter, and smaller, narrowing a space for an antenna device, so even a change in a shape of a radiator is restricted, making it problematic to freely implement a wideband and multiband antenna.

Also, in the case of a related art antenna device using a dielectric substance, in order to extend a bandwidth of a frequency band for resonance, a configuration of increasing an area of a circuit pattern in an antenna device is mainly used.

However, the use of an extended bandwidth inevitably involves an increase in an overall size of an antenna device, contrary to the tendency for compact antennas.

Thus, an antenna device, which may satisfy the requirements of being used in a wideband or multiple bands and having a small size, is required.

RELATED ART DOCUMENT (Patent document 1) Korean Patent Laid Open Publication No. 2011-0136409

SUMMARY OF THE INVENTION

An aspect of the present invention provides a multilayer ferrite sheet capable of performing communications in broadband communications and in multiple bands, an antenna device using the same, and a manufacturing method thereof.

Another aspect of the present invention provides a small, multilayer ferrite sheet for use in broadband communications, an antenna device using the same, and a manufacturing method thereof.

According to an aspect of the present invention, there is provided a multilayer ferrite sheet including: a Y-type hexaferrite layer; and a Z-type hexaferrite layer, wherein the Y-type hexaferrite and the Z-type hexaferrite are alternately laminated.

The Y-type hexaferrite layer and the Z-type hexaferrite layer may have different thicknesses.

at least Four Y-type hexaferrite layers and at least three Z-type hexaferrite layers may be provided.

According to another aspect of the present invention, there is provided an antenna device including: a multilayer ferrite sheet formed by alternately laminating a first ferrite sheet and a second ferrite sheet; and a radiator formed on at least one surface of the multilayer ferrite sheet.

The first ferrite sheet may be a Y-type hexaferrite sheet, and the second ferrite sheet may be a Z-type hexaferrite sheet.

The multilayer ferrite sheet may be formed such that a ratio between the overall thickness of the Y-type hexaferrite and the overall thickness of the Z-type hexaferrite is 70:30.

The Y-type hexaferrite sheets may include four layers, and the Z-type hexaferrite sheet may include three layers.

The first ferrite sheet may have a thickness equal to half of a thickness of the second ferrite sheet.

The first ferrite sheet and the second ferrite sheet may have the same thickness.

The first ferrite sheet and the second ferrite sheet may have different thicknesses.

The multilayer ferrite sheet may include at least one protective sheet attached to an outer surface thereof.

The multilayer ferrite sheet may be separated into a plurality of segments and integrally connected by the protective sheet.

According to another aspect of the present invention, there is provided a method for manufacturing an antenna device including: preparing a first ferrite sheet and a second ferrite sheet; and alternately laminating the first ferrite sheet and the second ferrite sheet.

The first ferrite sheet may be a Y-type hexaferrite sheet, and the second ferrite sheet may be a Z-type hexaferrite sheet.

The method may further include: compressing the first ferrite sheet and the second ferrite sheet, after the laminating of the first ferrite sheet and the second ferrite sheet.

The method may further include: forming separation slits on the at least one first ferrite sheet and the at least one second ferrite sheet, after the laminating of the at least one first ferrite sheet and the at least one second ferrite sheet.

The method may further include: attaching at least one protective film on the outside of the laminated at least one first ferrite sheet and the at least one second ferrite sheet, after the forming of the separation slits.

The method may further include: separating the laminated at least one first ferrite sheet and the at least one second ferrite sheet along the separation slits, after the attaching of the protective film.

The method may further include: forming at least one radiator on the outside of the protective film, after the separating.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
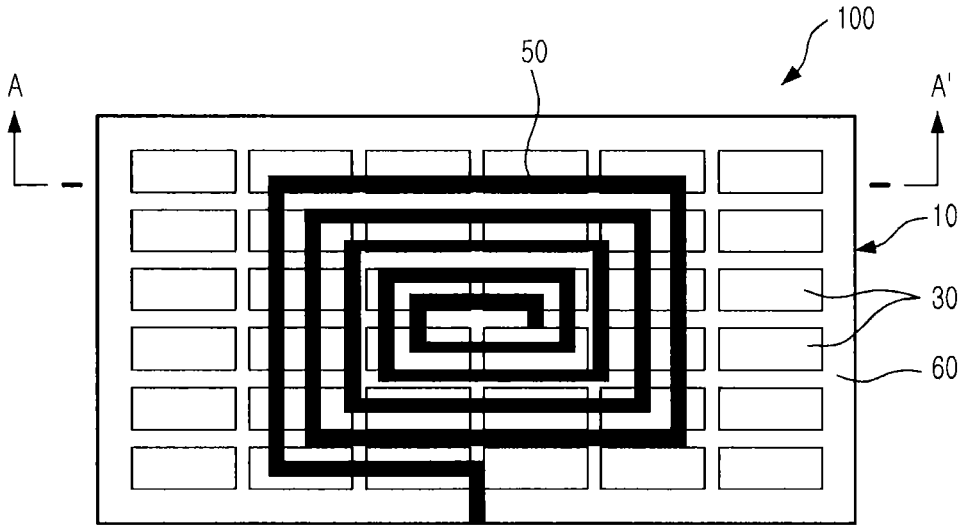
FIG. 1 is a plan view schematically illustrating an antenna device according to an embodiment of the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Figure 2:
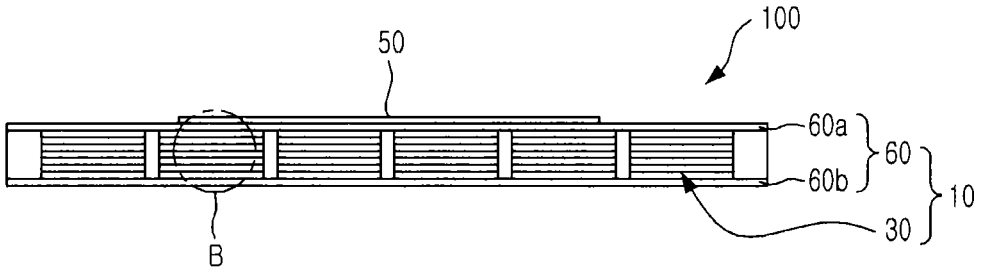
FIG. 2 is a cross-sectional view taken along line A-A' in FIG. 1.
Figure 3:
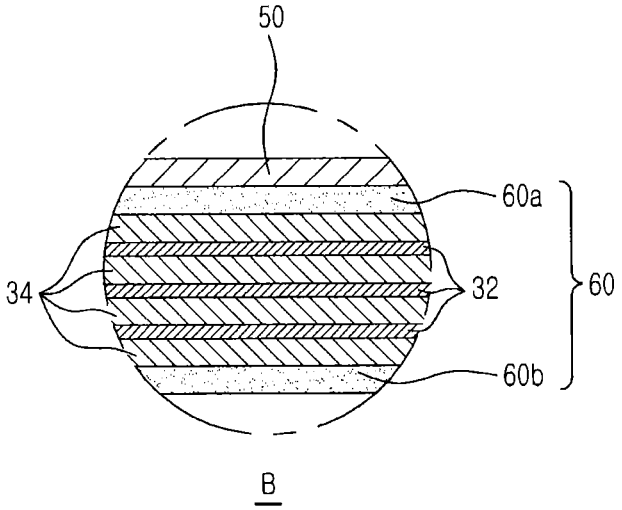
FIG. 3 is a partially enlarged cross-sectional view of portion 'B' in FIG. 2.

FIG. 1 is a plan view schematically illustrating an antenna device according to an embodiment of the present invention. FIG. 2 is a cross-sectional view taken along line A-A' in FIG. 1. FIG. 3 is a partially enlarged cross-sectional view of portion 'B' in FIG. 2.

Referring to FIGS. 1 through 3, an antenna device 100 according to an embodiment of the present invention may be configured as a flexible sheet made of soft magnetic hexaferrite having both permittivity and magnetic permeability, performing transmission and reception in a GHz band, and overcoming limitations in terms of a mounting area within a mobile device.

To this end, the antenna device according to an embodiment of the present invention may include a multilayer ferrite sheet 10 and a radiator 50.

The multilayer ferrite sheet 10 may include a ferrite layer 30, and a protective sheet 60 attached to any one surface of the ferrite layer 30.

The ferrite layer 30 may include a plurality of segments disposed on an upper surface of a lower film 60*b* as the protective sheet 60 and divided by grooves formed vertically and horizontally in a regular manner. Also, an upper film 60*a* as the protective sheet 60 may be disposed on an upper surface of the ferrite layer 30. The plurality of segments forming the ferrite layer 30 may be integrally connected by the protective sheet 60, maintaining an overall configuration.

Here, the ferrite layer 30 may be formed by disposing and attaching the respective segments to the lower film 60*b*. Alternatively, the ferrite layer may be formed as a sheet on the lower film 60*b* and separated into several segments so as to be formed. Namely, the ferrite layer 30 may be formed by using various methods.

Also, the ferrite layer 30 according to an embodiment of the present invention may be formed by laminating at least two different types of sheet; a first ferrite sheet and a second ferrite sheet. Namely, in the present embodiment, two types of hexaferrite sheet having different response frequency bands are alternately laminated to provide the antenna device 100 available in broadband communications.

Here, hexaferrite is a soft magnetic material, and Y-type and Z-type hexaferrite sheets 32 having high magnetic moment and low coercive force may be used.

The Z-type hexaferrite sheet 32, having a chemical formula $Ba_3Me_2Fe_{24}O_{41}$, is made of soft magnetic ferrite having high initial magnetic permeability, high saturation magnetization, and a ferromagnetic resonance frequency within a frequency ranging from a few MHz to 2 GHz. Research has been actively conducted to apply the Z-type hexaferrite sheet 32 to a magnetic semiconductor, a propagation shielding, or a microwave device or a mini-antenna within a frequency range of 1 to 2 GHz by using such properties. In general, a single phase Z-type hexaferrite sheet 32 has been known as being hardly formed because a Z-type phase is formed after a phase of a complicated precursor is formed. Thus various methods for synthesizing a single phase Z-type hexaferrite have been studied. Z-type barium hexaferrite includes all of S-blocks, R-blocks, and T-blocks and lamination order thereof is RSTSR*S*T*S*, having a very complicate crystal structure.

A chemical composition of a Z-type unit cell is represented by Equation 1 below:

$$4S+2R+2T=4(Fe_6O_8)+2(BaFe_6O_{11})+2(Ba_2Fe_8O_{14})=2(Ba_3Fe_{26}O_{41}) \quad \text{(Equation 1)}$$

Here, there are twenty-six Fe atoms, but like a general $Ba_3Me_2Fe_{24}O_{41}$ structure, 2 transition metal (Me) atoms may be substituted.

Me may be substituted by any element, and the most well known element is cobalt (Co). With reference to the Z-type ferrite in which cobalt (Co) is substituted by 2 ($Co_2$) includes two molecules per unit cell, and an M-type is laminated by RS and a Y-type is laminated by TS. Thus, since M+Y is RSTS, a Z-type crystal structure is M+Y.

Y-type hexaferrite is a magnetic substance having a chemical formula $Ba_2Me_2Fe_{12}O_{22}$ (Me: $Co^{2+}$, $Zn^{2+}$, $Ni^{2+}$, $Cu^{2+}$, etc.). The Y-type hexaferrite may be obtained by synthesizing M-type hexaferrite and spinel ferrite. The M-type hexaferrite has uniaxial magnetic anisotropy in a c-axis direction in a hexagonal structure, while the Y-type hexaferrite takes on planar magnetic anisotropy having an easy magnetization axis along a c-plane perpendicular to a c-axis, known as ferroxplanar ferrite. The Y-type hexaferrite sheet 34 having a planar magnetic anisotropy has a cut-off frequency equal to or greater than 1 GHz, higher than existing spinel ferrite, to have high initial permeability and a low dielectric constant in a high frequency band. The Y-type hexaferrite sheets 34 are laminated by S-blocks ($Fe_6O_8$) and T-blocks ($Ba_2Fe_8O_{14}$) in the c-axis direction. The Y-type unit cell is formed by laminating STST, and includes three molecules per unit cell.

Meanwhile, as illustrated in FIG. 3, in the present embodiment, seven ferrite layers 30 are formed, for example. Namely, the Y-type hexaferrite sheet 34 is disposed on the lower film 60*b*, the Z-type hexaferrite sheet 32 is laminated on the Y-type hexaferrite sheet 34, and the Y-type hexaferrite sheet 34 and the Z-type hexaferrite sheet 32 are alternately laminated again, and finally, the Y-type hexaferrite sheet 34 is laminated to complete the ferrite layer 30.

Also, in the multilayer ferrite sheet 10, a thickness of the first ferrite sheet formed by the Y-type hexaferrite sheet 34 and a thickness the second ferrite sheet formed by the Z-type hexaferrite sheet 32 may be equal or different.

For example, FIG. 3 illustrates a case in which the Y-type hexaferrite sheet 34 and the Z-type hexaferrite sheet 32 are configured to have a thickness ratio of 70:30, and the Y-type hexaferrite sheets 34 are formed as four layers, and the Z-type hexaferrite sheets 32 are formed as three layers.

Also, as described in Table 1 below, a case in which a thickness of the Z-type hexaferrite sheet 32 is half of a thickness of the Y-type hexaferrite sheet 34 is taken as an example.

However, the present invention is not limited thereto and the Z-type hexaferrite sheet 32 may have the same thickness as that of the Y-type hexaferrite sheet 34 and various applications may be used as necessary.

The radiator 50 may be formed on at least a portion of an external surface of the multilayer ferrite sheet 10. In a case in which the radiator 50 is disposed on both surfaces of the multilayer ferrite sheet 10, a dual-band antenna may be implemented and magnetic permeability appropriate for respective bands may be advantageously applied through the ferrite layers 30.

The radiator 50 according to the present embodiment may be fabricated separately from the multilayer ferrite sheet 10 and attached to the multilayer ferrite sheet 10, or alternatively, a pattern thereof may be directly formed on an outer surface of the multilayer ferrite sheet 10 so as to be integrally formed with the multilayer ferrite sheet 10.

For example, as a method for forming the radiator 50 on the multilayer ferrite sheet 10, sputtering, screen printing, foil transfer, gravure printing, or the like, may be used, but the present invention is not limited thereto.

Meanwhile, FIG. 1 illustrates a case in which the radiator 50 is formed to have an overall quadrangular spiral shape, as an example, but the present invention is not limited thereto and may be variously modified as necessary.

Also, an insulating film (not shown) may be formed on an outer surface of the radiator 50 in order to protect the radiator 50.

Hereinafter, a method for manufacturing an antenna device according to an embodiment of the present invention will be described.

Figure 4:
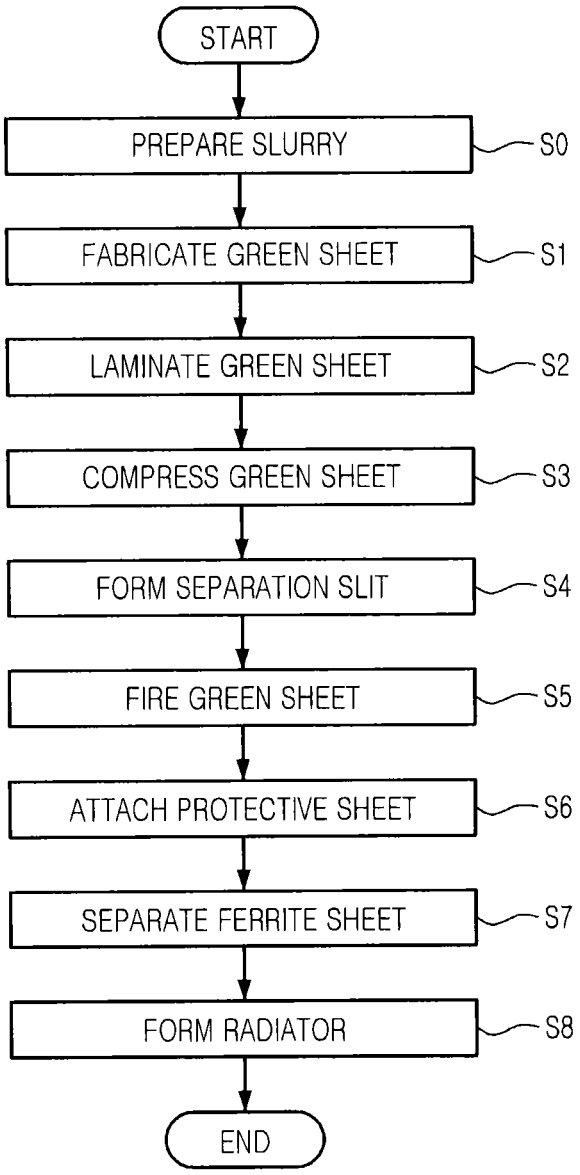
FIG. 4 is a flow chart illustrating a method for manufacturing the antenna device of FIG. 1.

FIG. 4 is a flow chart illustrating a method for manufacturing the antenna device of FIG. 1. FIGS. 5 through 9 are views illustrating a method for manufacturing the antenna device illustrated in FIG. 4.

Referring to FIGS. 4 and 5 through 9, in the method for manufacturing the antenna device 100, first, a slurry is prepared (S0). The slurry may be prepared by a method using a ball mill. In detail, the slurry may be obtained by disposing zirconia balls in a container and injecting a previously synthesized ferrite powder, a solvent obtained by mixing toluene and ethanol in a ratio of 8:2, a dispersing agent, and a binder into the container, and blending them at a predetermined rate (e.g., 150 rpm) for a predetermined time (e.g., about 10 hours). Here, in order to increase viscosity, a binder may be injected again and blending may be repeatedly performed thereon.

Figure 5:
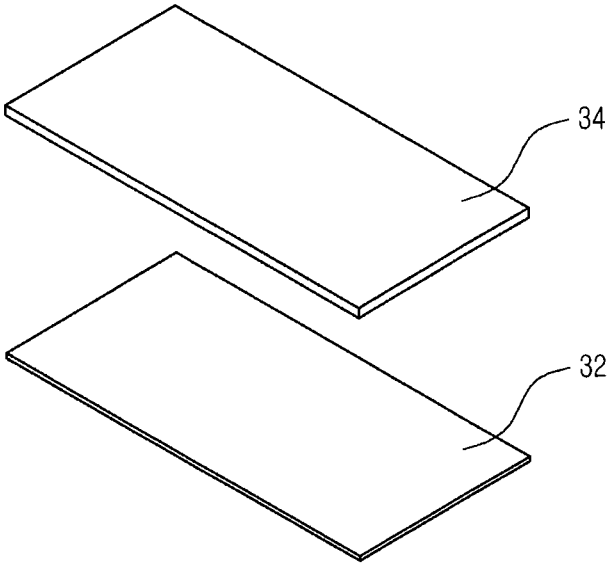
FIGS. 5 through 9 are views illustrating a method for manufacturing the antenna device illustrated in FIG. 4.

Subsequently, as illustrated in FIG. 5, a green sheet as illustrated in FIG. 5 is fabricated (S1). In this case, a Y-type hexaferrite green sheet 34 and a Z-type hexaferrite green sheet 32 may be fabricated, respectively. The green sheet may be fabricated by removing the solvent after the forming of the slurry. Here, in order to remove the solvent of the green sheet, a heating method may be used to heat the bottom on which the green sheet is installed.

Figure 6:
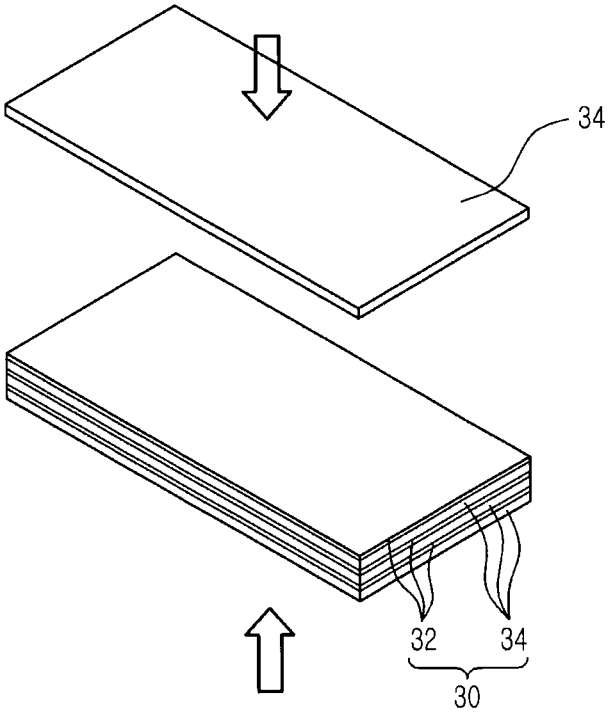

Subsequently, the ferrite layer 30 is fabricated. To this end, first, as illustrated in FIG. 6, a plurality of green sheets are laminated (S2) and pressurized to be compressed (S3). Here, in the case of the ferrite layer 30, as mentioned above, the Y-type hexaferrite sheets 34 and the Z-type hexaferrite sheet 32 may be alternately laminated and compressed.

Figure 7:
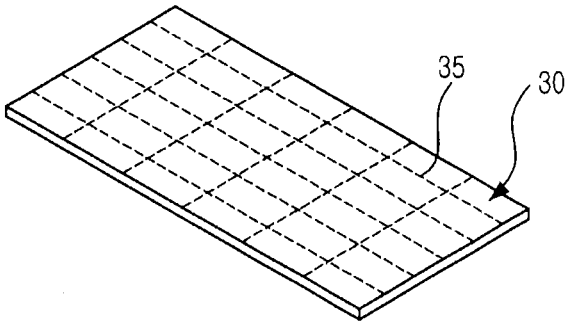

Thereafter, as illustrated in FIG. 7, a plurality of separation slits 35 are formed in a predetermined direction on the ferrite layer 30 (S4). For example, the separation slits 35 may be iteratively formed at predetermined intervals in one or more of a horizontal direction, a vertical direction, and a diagonal direction of the ferrite sheet.

Here, the separation slits 35 may be formed as grooves. Namely, the separation slits 35 may be formed to have a depth of about half of a thickness of the laminated ferrite layer 30. However, the present invention is not limited thereto and the separation slits 35 may be formed as through holes. In this case, a process of controlling a depth of the grooves may be limited in the process of forming the separation slits 35, facilitating the process.

The separation slits 35 may be formed through a punching process using a punch, or may be formed by using a linear blade or a roller type blade.

The separation slits 35 are formed to easily separate the ferrite layer 30 into a plurality of segments. Namely, due to the presence of the separation slits 35, the ferrite layer 30 may be separated into a plurality of fine segments.

Thereafter, the ferrite layer 30 with the plurality of separation slits 35 formed thereon is fired (S5).

Figure 8:
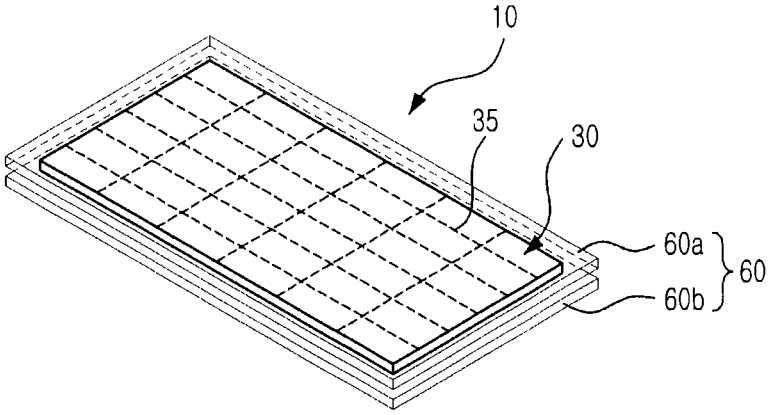

When the firing operation is terminated, the upper film 60*a* and the lower film 60*b*, formed as protective sheets, are attached to one surface or both surfaces of the ferrite layer 30 as illustrated in FIG. 8 (S6). Here, the upper film 60 may be a PET film and the lower film 60*b* may be a PET film or an adhesive film.

Figure 9:
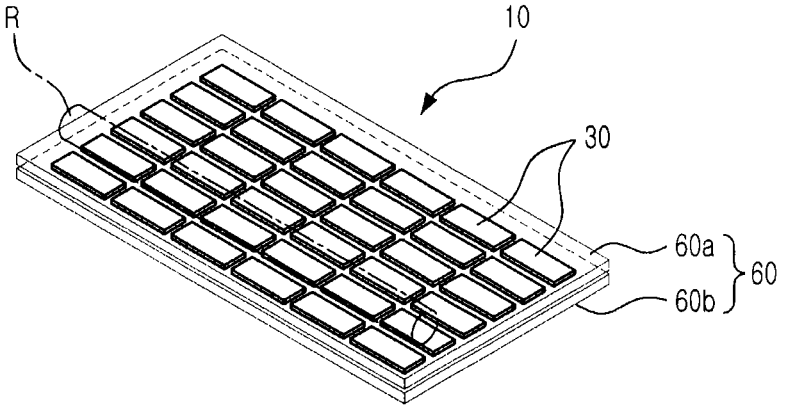

Subsequently, as illustrated in FIG. 9, the ferrite layer 30 the ferrite layer 30 is separated into a plurality of fine segments (S7). This process may be performed by positioning a cylindrical roller R or bar on one side of the ferrite layer 30 and applying force to the roller R or bar to pressurize the ferrite layer 30, while moving the ferrite layer 30 in a predetermined direction.

Accordingly, the ferrite layer 30 is split into a plurality of fine segments along the separation slits 35. Here, since the fine segments of the ferrite layer 30 are in a separated state between the upper film 60*a* and the lower film 60*b*, the multilayer ferrite sheet 10 has flexibility.

Thereafter, the radiator 50 is formed on at least one surface of the multilayer ferrite sheet 10 (S8). The radiator 50 is provided for a substantial operation of the antenna device 100. The radiator 50 may be made of at last one of conductive material, e.g., silver (Ag), palladium (Pd), platinum (Pt), copper (Cu), gold (Au), nickel (Ni), and the like, on the surface of the multilayer ferrite sheet 10. Here, the radiator 50 may be formed through patterning, e.g., printing, plating, depositing, sputtering, or the like.

Through the foregoing process, the antenna device 100 illustrated in FIG. 1 is completed.

Since the multilayer ferrite sheet 10 has flexibility, the antenna device 100 according to the present embodiment manufactured as described above can be readily attached to a target having a curved surface or an uneven surface, and thus, adhesion precision of the multilayer ferrite sheet 10 can be enhanced.

Also, the antenna device 100 according to the present embodiment may be formed as any one of a meander-type, a spiral-type, a step-type, or a loop-type transmission circuit. Here, a circuit pattern 240 may be implemented to have an inverted L antenna (ILA) structure, an inverted F antenna (IFA) structure, a monopole antenna structure, or the like.

The antenna device 100 transmits and receives signals in a predetermined frequency band. Namely, when a signal is applied to the radiator 50, the radiator 50 resonates in a predetermined frequency band to allow the signal to pass therethrough. Here, the frequency band for the radiator 50 to resonate therein may be adjusted according to a size, a shape, or the like, of the radiator 50.

Figure 10:
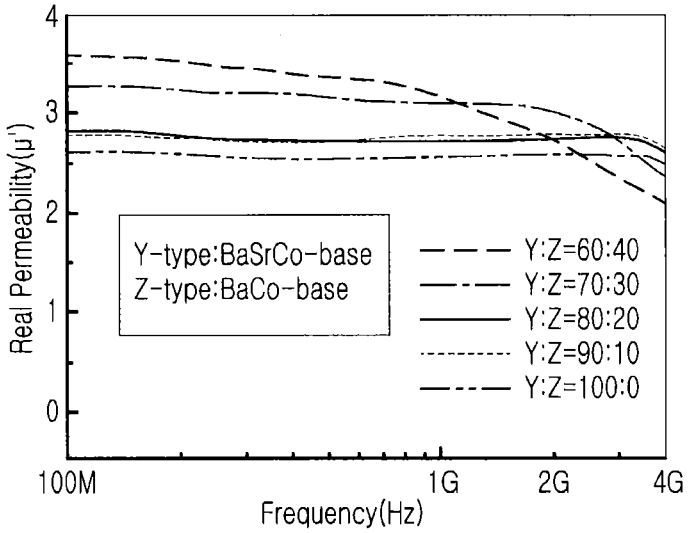
FIG. 10 is a graph showing measurements of the characteristics of the antenna device according to an embodiment of the present invention.

FIG. 10 is a graph showing measurements of the characteristics of the antenna device according to an embodiment of the present invention. FIG. 4 shows data of frequencies and magnetic permeability measured by using a ferrite layer obtained by alternately laminating Y-type hexaferrite sheets and Z-type hexaferrite sheets and finally sintering the same at a temperature of 1200□.

Table 1 below shows lamination structures and thicknesses of respective layers of the Y-type hexaferrite sheet and the Z-type hexaferrite sheet.

TABLE 1

| Y:Z | Lamination structure | Thickness (mm) |
|---|---|---|
| 60:40 | Y:Z:Y:Z:Y | 0.1:0.1:0.1:0.1:0.1 |
| 70:30 | Y:Z:Y:Z:Y:Z:Y | 0.1:0.05:0.05:0.1:0.05:0.05:0.1 |
| 80:20 | Y:Z:Y:Z:Y | 0.15:0.05:0.1:0.05:0.15 |
| 90:10 | Y:Z:Y | 0.25:0.05:0.2 |
| 100:0 | Y | 0.5 |

Here, Y:Z refers to a thickness ratio of the Y-type hexaferrite sheets and the Z-type hexaferrite sheets in the overall thickness of the multilayer ferrite sheets.

Table 2 below shows magnetic permeability, permittivity, and the like, according to the multilayer structure of the Y-type hexaferrite sheets and the Z-type hexaferrite sheets.

TABLE 2

| Y:Z | Magnetic permeability | Loss of magnetic permeability | Permittivity | Loss of permittivity |
|---|---|---|---|---|
| 60:40 | 3.51 | 0.36 | 19.4 | 0.265 |
| 70:30 | 3.24 | 0.24 | 14.8 | 0.006 |
| 80:20 | 2.76 | 0.13 | 13.9 | 0.005 |
| 90:10 | 2.73 | 0.13 | 14.6 | 0.005 |
| 100:0 | 2.56 | 0.13 | 13.5 | 0.005 |

Referring to Table 1, Table 2, and FIG. 10, it can be seen that magnetic permeability of the ferrite layer was increased as the proportion of the Z-type hexaferrite was gradually increased. However, in the case of Y:Z=60:40, the magnetic permeability was sharply reduced in a high frequency region (e.g., 2 GHz or higher) and the loss of permeability was more than 0.3 as shown in Table 2, which is, thus, not appropriate even in terms of efficiency.

Meanwhile, in the case of Y:Z=70:30, the magnetic permeability stood at more than 3 even in the 2 GHz band and loss of magnetic permeability was less than 0.3. Thus, when the ferrite layer is configured to have a structure of Y:Z=70:30, it can have high magnetic permeability more than 3 and extensively used within a range from a low frequency band to the 2 GHz band As described above, in an embodiment of the present invention, since the antenna device is implemented to have a multilayer ferrite sheet by laminating Y-type hexaferrite sheets and Z-type hexaferrite sheets, bandwidths of available frequency bands of the antenna can be extended. Namely, the antenna device can support broadband communications.

In particular, since the antenna device according to an embodiment of the present invention has both the low frequency band characteristics (high magnetic permeability) of the Z-type hexaferrite and the high frequency band characteristics of the Y-type hexaferrite, the antenna device may be used in broadband communications and have higher magnetic permeability than that of the case of using general ferrite or using only the Y-type hexaferrite.

Thus, even without increasing the size of the antenna device, a loss rate according to driving of the antenna device in an extended bandwidth can be minimized. Also, a bandwidth of a frequency band available for the antenna device can be extended and the antenna device can be reduced in size.

As set forth above, in the case of the multilayer ferrite sheet and the antenna device using the same according to embodiments of the invention, since the multilayer ferrite sheet has flexibility, it can be readily attached to a target having a curved surface or an uneven surface, and thus, adhesion precision of the multilayer ferrite sheet can be enhanced.

Also, since the antenna device is implemented to have a multilayer ferrite sheet by laminating Y-type hexaferrite sheets and Z-type hexaferrite sheets, bandwidths of available frequency bands of the antenna can be extended. Namely, the antenna device can support broadband communications.

In particular, since the antenna device according to an embodiment of the present invention has both the low frequency band characteristics (high magnetic permeability) of the Z-type hexaferrite and the high frequency band characteristics of the Y-type hexaferrite, the antenna device may be used in broadband communications and can have higher magnetic permeability than that of the case of using general ferrite or using only the Y-type hexaferrite.

Thus, even without increasing the size of the antenna device, a loss rate according to driving of the antenna device in an extended bandwidth can be minimized. Also, a bandwidth of a frequency band available for the antenna device can be extended and the antenna device can be reduced in size.

While the present invention has been shown and described in connection with the embodiments, it will be apparent to those skilled in the art that modifications and variations can be made without departing from the spirit and scope of the invention as defined by the appended claims.

What is claimed is:

1. A multilayer ferrite sheet comprising:

a Y-type hexaferrite layer; and a Z-type hexaferrite layer, wherein both of the Y-type hexaferrite layer and the Z-type hexaferrite layer are formed of a soft magnetic material, a chemical formula of the Y-type hexaferrite layer is $Ba_2Me1_2Fe_{12}O_{22}$, where Me1 is a transition metal, and a chemical formula of the Z-type hexaferrite layer is $Ba_3Me2_2Fe_{24}O_{41}$, where Me2 is a transition metal, and the Y-type hexaferrite layer and the Z-type hexaferrite layer are alternately laminated.

2. The multilayer ferrite sheet of claim 1, wherein the Y-type hexaferrite layer and the Z-type hexaferrite layer have different thicknesses.

3. The multilayer ferrite sheet of claim 1, wherein at least four Y-type hexaferrite layers and at least three Z-type hexaferrite layers are provided.

4. An antenna device comprising:

a multilayer ferrite sheet formed by alternately laminating a first ferrite sheet and a second ferrite sheet; and a radiator formed on at least one surface of the multilayer ferrite sheet, wherein the first ferrite sheet is a Y-type hexaferrite sheet, and the second ferrite sheet is a Z-type hexaferrite sheet, both of the Y-type hexaferrite sheet and the Z-type hexaferrite sheet are formed of a soft magnetic material, and a chemical formula of the Y-type hexaferrite sheet is $Ba_2Me1_2Fe_{12}O_{22}$, where Me1 is a transition metal, and a chemical formula of the Z-type hexaferrite sheet is $Ba_3Me2_2Fe_{24}O_{41}$, where Me2 is a transition metal.

5. The antenna device of claim 4, wherein the multilayer ferrite sheet is formed such that a ratio between the overall thickness of the Y-type hexaferrite and the overall thickness of the Z-type hexaferrite is 70:30.

6. The antenna device of claim 5, wherein the Y-type hexaferrite sheet includes four layers, and the Z-type hexaferrite sheet includes three layers.

7. The antenna device of claim 6, wherein the first ferrite sheet has a thickness equal to half of a thickness of the second ferrite sheet.

8. The antenna device of claim 4, wherein the first ferrite sheet and the second ferrite sheet have the same thickness.

9. The antenna device of claim 4, wherein the first ferrite sheet and the second ferrite sheet have different thicknesses.

10. The antenna device of claim 4, wherein the multilayer ferrite sheet includes at least one protective sheet attached to an outer surface thereof.

11. The antenna device of claim 10, wherein the multilayer ferrite sheet is separated into a plurality of segments and integrally connected by the protective sheet.

12. A method for manufacturing an antenna device, the method comprising:

preparing a first ferrite sheet and a second ferrite sheet; and alternately laminating the first ferrite sheet and the second ferrite sheet, wherein the first ferrite sheet is a Y-type hexaferrite sheet, and the second ferrite sheet is a Z-type hexaferrite sheet, both of the Y-type hexaferrite sheet and the Z-type hexaferrite sheet are formed of a soft magnetic material, and a chemical formula of the Y-type hexaferrite sheet is $Ba_2Me1_2Fe_{12}O_{22}$, where Me1 is a transition metal, and a chemical formula of the Z-type hexaferrite sheet is $Ba_3Me2_2Fe_{24}O_{41}$, where Me2 is a transition metal.

13. The method of claim 12, further comprising:

compressing the first ferrite sheet and the second ferrite sheet, after the laminating of the first ferrite sheet and the second ferrite sheet.

14. The method of claim 12, further comprising:

forming separation slits on the at least one first ferrite sheet and the at least one second ferrite sheet, after the laminating of the at least one first ferrite sheet and the at least one second ferrite sheet.

15. The method of claim 14, further comprising:

attaching at least one protective film on the outside of the laminated at least one first ferrite sheet and the at least one second ferrite sheet, after the forming of the separation slits.

16. The method of claim 15, further comprising:

separating the laminated at least one first ferrite sheet and the at least one second ferrite sheet along the separation slits, after the attaching of the protective film.

17. The method of claim 16, further comprising:

forming at least one radiator on the outside of the protective film, after the separating.

* * * * *